US009429154B2

(12) United States Patent
Ishikawa et al.

(10) Patent No.: US 9,429,154 B2
(45) Date of Patent: Aug. 30, 2016

(54) ELECTROMAGNETIC PUMP DEVICE

(75) Inventors: Kazunori Ishikawa, Toyota (JP); Masaya Nakai, Tokoname (JP)

(73) Assignee: AISIN AW CO., LTD., Anjo (JP)

( * ) Notice: Subject to any disclaimer, the term of this patent is extended or adjusted under 35 U.S.C. 154(b) by 336 days.

(21) Appl. No.: 14/124,467

(22) PCT Filed: Jul. 25, 2012

(86) PCT No.: PCT/JP2012/068833

§ 371 (c)(1),
(2), (4) Date: Dec. 6, 2013

(87) PCT Pub. No.: WO2013/027528

PCT Pub. Date: Feb. 28, 2013

(65) Prior Publication Data

US 2014/0119964 A1 May 1, 2014

(30) Foreign Application Priority Data

Aug. 24, 2011 (JP) ..... 2011-183147

(51) Int. Cl.
*F04B 53/10* (2006.01)
*F04B 53/12* (2006.01)
(Continued)

(52) U.S. Cl.
CPC ..... *F04B 53/1002* (2013.01); *F04B 17/04* (2013.01); *F04B 17/042* (2013.01); *F04B 17/044* (2013.01); *F04B 53/126* (2013.01); *F04B 53/20* (2013.01)

(58) Field of Classification Search
CPC ..... F04B 53/1087; F04B 53/1002; F04B 53/126; F04B 53/20; F04B 17/042; F04B 17/046; F04B 17/044; F04B 17/04; F16H 61/0031; F16H 61/0206; H02K 44/04; H02K 44/06; A61M 5/14276
USPC ..... 417/559, 569, 570; 251/333
See application file for complete search history.

(56) References Cited

U.S. PATENT DOCUMENTS 8,414,276 B2 4/2013 Schuller et al.
2007/0183911 A1* 8/2007 Maeda ..... B60T 8/4031 417/470

(Continued)

FOREIGN PATENT DOCUMENTS

CH 107694 A 11/1924
CH 447 818 A 11/1967

(Continued)

OTHER PUBLICATIONS

International Search Report issued in International Patent Application No. PCT/JP32012/068833 dated Oct. 30, 2012.

*Primary Examiner* — William H. Rodriguez
*Assistant Examiner* — Christopher Brunjes
(74) *Attorney, Agent, or Firm* — Oliff PLC

(57) ABSTRACT

An electromagnetic pump including a suction check valve including a tubular portion and a flange portion that extends in a radial direction from an end edge of the tubular portion, the suction check valve being formed with a through hole that penetrates the tubular portion and the flange portion to form a suction port in an end surface of the flange portion. A strainer attached to the suction port and having a pore forming region which is larger than an inside diameter of the through hole at the tubular portion and in which a large number of pores are formed. The suction check valve is formed with a diameter reducing portion formed such that the inside diameter of the through hole is reduced from the flange portion toward the tubular portion with a degree of diameter reduction varied from a large value to a small value.

7 Claims, 6 Drawing Sheets

(51) Int. Cl.
*F04B 53/20* (2006.01)
*F04B 17/04* (2006.01)

(56) References Cited

U.S. PATENT DOCUMENTS

| | | | | |
|---|---|---|---|---|
| 2009/0220363 | A1* | 9/2009 | Schuller | B60T 8/4031 417/510 |
| 2011/0293449 | A1* | 12/2011 | Shimizu | F04B 17/044 417/415 |
| 2012/0244022 | A1 | 9/2012 | Nakai et al. | |

FOREIGN PATENT DOCUMENTS

| | | | | |
|---|---|---|---|---|
| CH | 447818 | A * | 11/1967 | F04B 17/046 |
| CN | 2729362 | Y | 9/2005 | |
| DE | 853 367 | C | 10/1952 | |
| DE | 10 2006 029 368 | A1 | 1/2008 | |
| GB | 537334 | A | 6/1941 | |
| JP | B2-3758756 | | 3/2006 | |
| JP | A-2006-291914 | | 10/2006 | |
| JP | A-2011-21593 | | 2/2011 | |
| JP | 2012-202339 | A | 10/2012 | |

* cited by examiner

FIG. 6A COMPARATIVE EXAMPLE 1
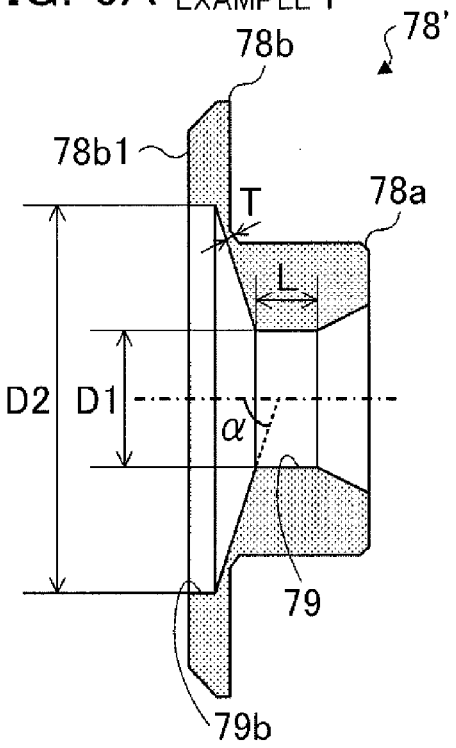
FIG. 6B COMPARATIVE EXAMPLE 2
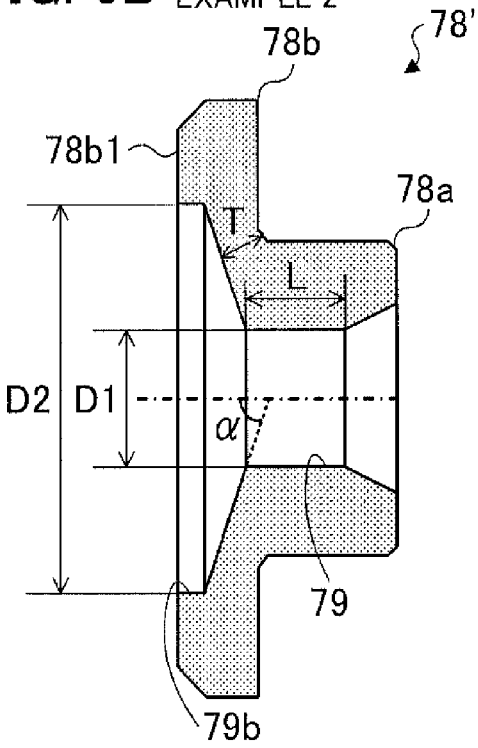
FIG. 6C COMPARATIVE EXAMPLE 3
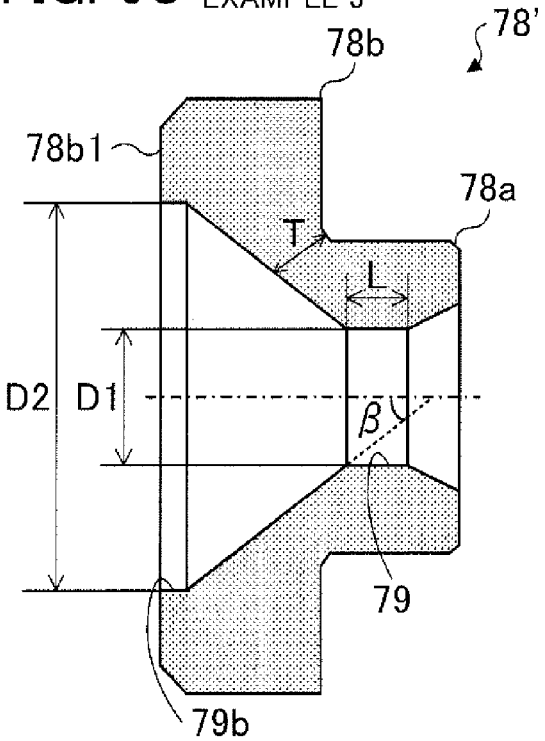

ELECTROMAGNETIC PUMP DEVICE

INCORPORATION BY REFERENCE

The disclosure of Japanese Patent Application No. 2011-183147 filed on Aug. 24, 2011 including the specification, drawings and abstract is incorporated herein by reference in its entirety.

BACKGROUND OF THE INVENTION

The present invention relates to an electromagnetic pump device in which a strainer is attached to a suction port.

DESCRIPTION OF THE RELATED ART

Hitherto, there has been proposed an electromagnetic pump device of this type, including an electromagnetic portion, a movable iron core capable of moving back and forth in the axial direction inside a pump chamber by turning on and off the electromagnetic portion, an inlet check valve mechanism that is built in the pump chamber and that allows working oil to flow in one direction from a suction port into the pump chamber, and an outlet check valve mechanism that is built in the pump chamber and that allows working oil to flow in one direction from the pump chamber to a discharge port (see Japanese Patent Application Publication No. 2006-291914 (JP 2006-291914 A), for example). In the electromagnetic pump device, the suction port extends in the axial direction from the inlet check valve mechanism, and opens in a direction orthogonal to the axial direction to be connected to an oil passage. A strainer is attached at the connection portion to remove foreign matter such as dust. In order to reduce the resistance against flow of the working oil through the strainer, a stepped portion is formed such that the portion of connection with the oil passage is slightly larger in diameter than the suction port.

SUMMARY OF THE INVENTION

In some of the thus configured electromagnetic pump devices, the inlet check valve mechanism is formed with a suction port that opens in the axial direction, and the strainer is disposed immediately before the inlet check valve mechanism. Also in such devices, it is conceivable to provide the stepped portion discussed above at the suction port in the inlet check valve mechanism. In order to provide the stepped portion, however, it is necessary to make the suction port of the inlet check valve mechanism slightly larger in inside diameter and then expand the inlet check valve mechanism in the axial direction, which may make the inlet check valve mechanism larger to lead to an increase in size of the electromagnetic pump device.

It is a main object of the electromagnetic pump device according to the present invention to smoothly suck a working fluid and have a compact configuration.

In order to achieve the foregoing main object, the electromagnetic pump device according to the present invention adopts the following means.

According to an aspect of the present invention, an electromagnetic pump device includes:

a suction check valve including a tubular portion and a flange portion that extends in a radial direction from an end edge of the tubular portion, the suction check valve being formed with a through hole that penetrates the tubular portion and the flange portion to form a suction port in an end surface of the flange portion; and a strainer attached to the suction port and having a pore forming region which is larger than an inside diameter of the through hole at the tubular portion and in which a large number of pores are formed, in which the suction check valve is formed with a diameter reducing portion formed such that the inside diameter of the through hole is reduced from the flange portion toward the tubular portion with a degree of diameter reduction varied from a large value to a small value.

The electromagnetic pump device according to the aspect of the present invention includes the suction check valve including the tubular portion and the flange portion which extends in the radial direction from an end edge of the tubular portion, the suction check valve being formed with the through hole which penetrates the tubular portion and the flange portion to form the suction port in an end surface of the flange portion, and the suction check valve is formed with the diameter reducing portion formed such that the inside diameter of the through hole is reduced from the flange portion toward the tubular portion with the degree of diameter reduction varied from a large value to a small value. Thus, the thickness at the boundary portion between the flange portion and the cylindrical portion can be suppressed while an increase in thickness of the flange portion is secured compared to a configuration in which the degree of diameter reduction is constant. In addition, a working fluid can be smoothly sucked through diameter reduction at the diameter reducing portion. As a result, it is possible to allow a working fluid to be smoothly sucked and to provide an electromagnetic pump device with a compact configuration.

In the electromagnetic pump device according to the above aspect of the present invention, the diameter reducing portion may be formed from two stages of tapered surfaces with different inclination angles. With this configuration, the diameter reducing portion can be formed though relatively easy processing. In the electromagnetic pump device according to this aspect of the present invention, in the diameter reducing portion, an inflection point at which the inclination angle of the two stages of tapered surfaces is varied may be determined at a position at which a thickness at a boundary portion between the tubular portion and the flange portion is equal to or more than a predetermined thickness. With this configuration, the thickness of the boundary portion between the flange portion and the cylindrical portion can be more reliably secured.

In the electromagnetic pump device according to the aspect of the present invention, the suction check valve may include a straight portion provided between the end surface of the flange portion and the diameter reducing portion, the straight portion having a uniform diameter corresponding to an inside diameter of the suction port. With this configuration, a working fluid can be sucked more smoothly. In addition, the area of the end surface of the flange portion covered by the strainer can be made relatively large, and thus the pressure of a working fluid applied to the strainer can be received more appropriately.

In the electromagnetic pump device according to the aspect of the present invention, the suction check valve may be formed such that the inside diameter of the suction port is larger than an outside diameter of the tubular portion. Reducing the diameter of such an opening member with a constant degree from a second inside diameter toward a first inside diameter tends to result in a portion in which the thickness is locally significantly reduced. Therefore, the present invention can be applied highly significantly.

In the electromagnetic pump device according to the aspect of the present invention in which a piston moves back and forth within a cylinder to pump a working fluid, the suction check valve may be built in the cylinder. With this configuration, the electromagnetic pump device can be provided with a more compact configuration.

BRIEF DESCRIPTION OF THE DRAWINGS

FIGS. 6A to 6C illustrate comparative examples for cases where a diameter reducing portion is formed differently from that in the embodiment;

DETAILED DESCRIPTION OF THE EMBODIMENTS

An embodiment of the present invention will be described below.

Figure 1:
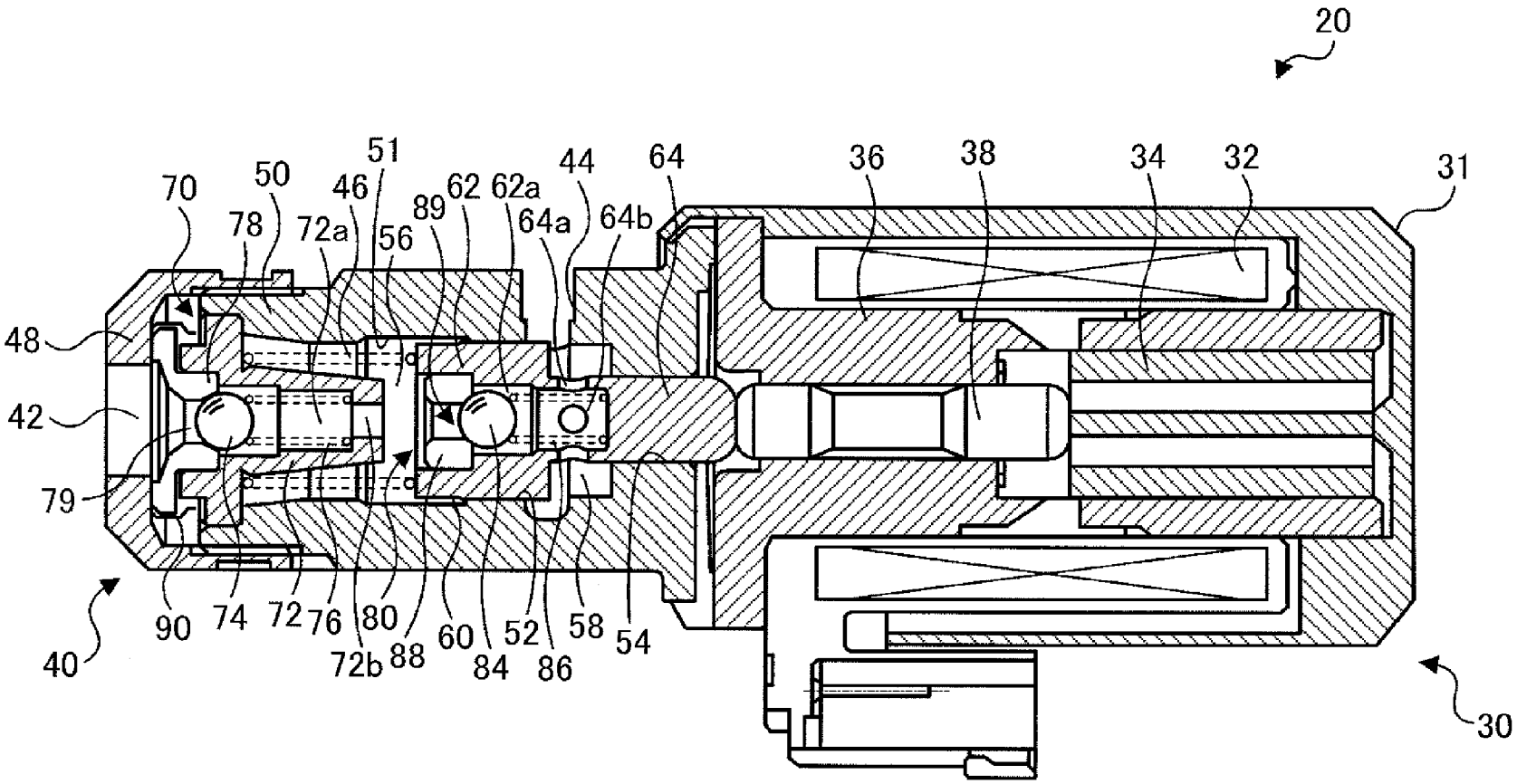
FIG. 1 is a diagram showing a schematic configuration of an electromagnetic pump 20 according to an embodiment of the present invention.

FIG. 1 is a diagram showing a schematic configuration of an electromagnetic pump 20 according to an embodiment of the present invention. The electromagnetic pump 20 according to the embodiment includes a solenoid portion 30 that generates an electromagnetic force, and a pump portion 40 actuated by the electromagnetic force of the solenoid portion 30. The electromagnetic pump 20 may be formed as a part of a hydraulic control device provided in a vehicle incorporating an engine and an automatic transmission to hydraulically drive friction engagement elements (clutches and brakes) included in the automatic transmission.

The solenoid portion 30 includes a solenoid case 31 that is a bottomed cylindrical member, an electromagnetic coil 32, a plunger 34 that serves as a movable element, and a core 36 that serves as a stationary element. The electromagnetic coil 32, the plunger 34, and the core 36 are disposed in the solenoid case 31. In the solenoid portion 30, a current is applied to the electromagnetic coil 32 to form a magnetic circuit in which magnetic flux circulates through the solenoid case 31, the plunger 34, and the core 36, and the plunger 34 is attracted to push out a shaft 38 provided in abutment with the distal end of the plunger 34.

The pump portion 40 is formed as a piston pump that moves a piston 60 back and forth using the electromagnetic force from the solenoid portion 30 and the urging force of a spring 46 to pump working oil. The pump portion 40 includes: a cylinder 50 having a hollow cylindrical shape with its one end joined to the solenoid case 31 of the solenoid portion 30; the piston 60 slidably disposed within the cylinder 50 with its base end surface coaxially abutting against the distal end of the shaft 38 of the solenoid portion 30; the spring 46 that abuts against the distal-end surface of the piston 60 to urge the piston 60 in the direction opposite to the direction in which the electromagnetic force from the solenoid portion 30 is applied; a suction check valve 70 that supports the spring 46 from the side opposite to the distal-end surface of the piston 60, that permits working oil to flow in the direction of being sucked into a pump chamber 56, and that prohibits working oil to flow in the opposite direction; a strainer 90 disposed at the suction port of the suction check valve 70 to trap foreign matter such as dust contained in sucked working oil; a discharge check valve 80 that is built in the piston 60, that permits working oil to flow in the direction of being discharged from the pump chamber 56, and that prohibits working oil to flow in the opposite direction; and a cylinder cover 48 that covers the other end of the cylinder 50 with the piston 60, the discharge check valve 80, the spring 46, and the suction check valve 70 disposed inside the cylinder 50. In the pump portion 40, a suction port 42 is formed at the axial center of the cylinder cover 48, and a discharge port 44 is formed by cutting away a part of the side surface of the cylinder 50 in the circumferential direction.

The piston 60 is formed in a stepped shape with a piston main body 62 having a cylindrical shape, and a shaft portion 64 having a cylindrical shape with its end surface in abutment with the distal end of the shaft 38 of the solenoid portion 30 and being smaller in outside diameter than the piston main body 62. The piston 60 moves back and forth within the cylinder 50 in conjunction with the shaft 38 of the solenoid portion 30. A bottomed hollow portion 62*a* having a cylindrical shape is formed at the axial center of the piston 60. The discharge check valve 80 is disposed in the hollow portion 62*a*. The hollow portion 62*a* extends from the distal-end surface of the piston 60 through the inside of the piston main body 62 to a middle of a space inside the shaft portion 64. The shaft portion 64 is formed with two through holes 64*a* and 64*b* that intersect each other at an angle of 90 degrees in the radial direction. The discharge port 44 is formed around the shaft portion 64. The hollow portion 62*a* communicates with the discharge port 44 via the two through holes 64*a* and 64*b*.

Figure 2:
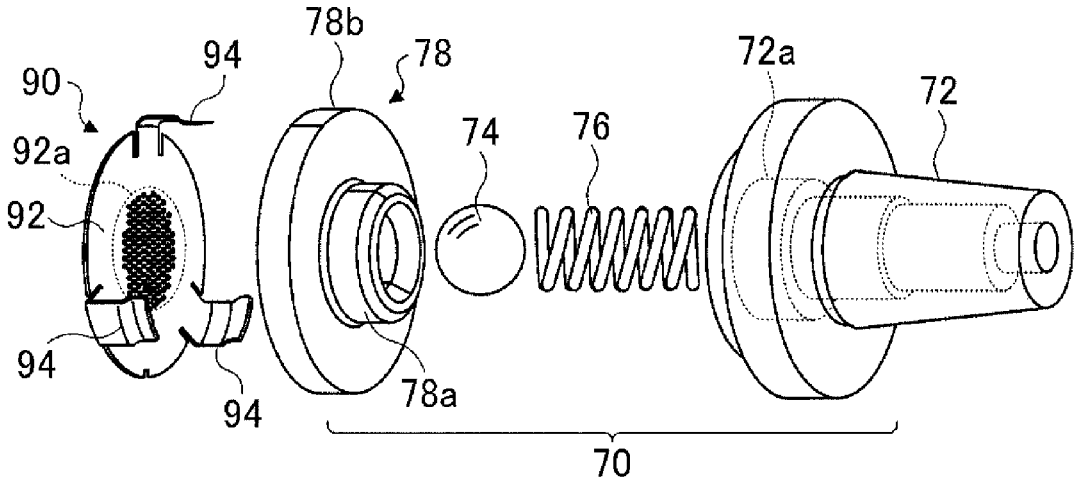
FIG. 2 illustrates how a suction check valve 70 is assembled.
Figure 3:
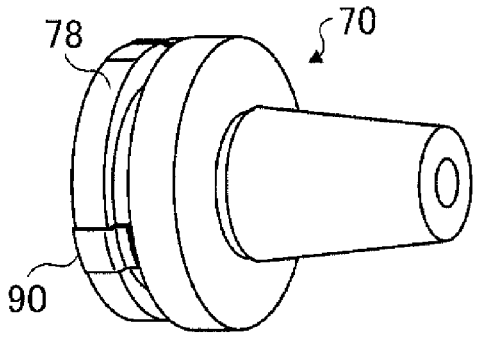
FIG. 3 shows the appearance of the suction check valve 70 after being assembled.

The suction check valve 70 includes a valve main body 72 fitted into the cylinder 50 and having a bottomed hollow portion 72*a* formed inside thereof and a center hole 72*b* formed at the axial center in the bottom of the hollow portion 72*a* to communicate between the hollow portion 72*a* and the pump chamber 56, a ball 74, a spring 76 that provides an urging force to the ball 74, and a plug 78 that serves as a seat portion for the ball 74. FIG. 2 illustrates how the suction check valve 70 is assembled. FIG. 3 shows the appearance of the suction check valve 70 after being assembled. As shown in the drawing, the suction check valve 70 is assembled by sequentially inserting the spring 76 and the ball 74 into the hollow portion 72*a* of the valve main body 72, and press-fitting the plug 78 into the hollow portion 72*a*. The plug 78 is formed as a flanged cylindrical member including a cylindrical portion 78*a* having an outside diameter that allows the plug 78 to be press-fitted into the hollow portion 72*a* of the valve main body 72, and a flange portion 78*b* that extends in the radial direction from the end edge of the cylindrical portion 78*a*. The strainer 90 is attached so as to cover the end surface of the flange portion 78*b*. As shown in FIG. 2, the strainer 90 is composed of a disk portion 92, in the center region of which a large number of pores are formed (pore forming region 92*a*) to form a strainer surface, and three leg portions 94 which extend from the outer peripheral edge of the disk portion 92 in the orthogonal direction and at the distal end of which clips that are bent inward are provided. Therefore, when the leg portions 94 of the strainer 90 are placed over the flange portion 78*b* of the plug 78 as shown in FIG. 3, the clips at the distal end of the leg portions 94 are engaged with a stepped portion between the flange portion 78*b* and the cylindrical portion 78*a*, preventing the strainer 90 from slipping off. In the embodiment, the suction check valve 70 and the strainer 90 are assembled in this way to form a sub-assembly (see FIG. 3).

Figure 4:
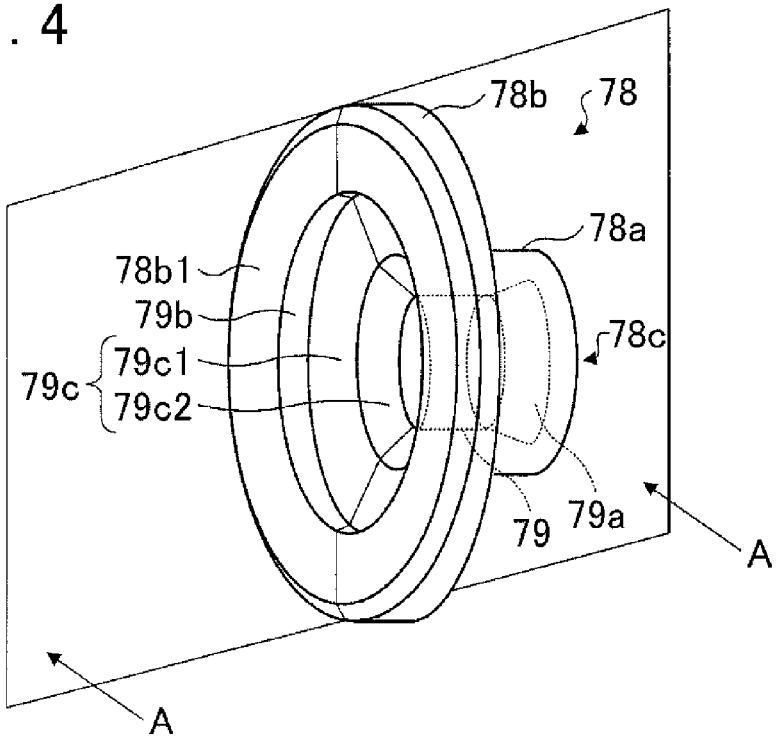
FIG. 4 is a perspective view of a plug 78.
Figure 5:
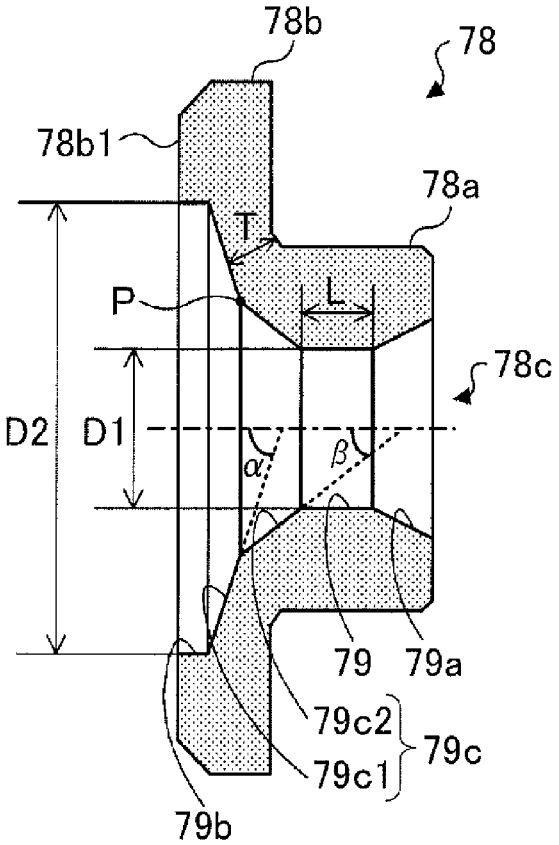
FIG. 5 is an A-A sectional view showing an A-A section in the perspective view of the plug 78 of FIG. 4.

Here, the shape of the plug 78 of the suction check valve 70 will be described in detail. FIG. 4 is a perspective view of the plug 78. FIG. 5 shows an A-A section in the perspective view of the plug 78 of FIG. 4. As shown in the drawing, the plug 78 is formed with a through hole 78*c* that penetrates the cylindrical portion 78*a* and the flange portion 78*b*. A center portion 79 with an inside diameter D1 that is smaller than the outside diameter of the ball 74 and with a length L is formed on the cylindrical portion 78*a* side. The inside diameter D1 is determined, for example, on the basis of the flow amount of working oil that passes through the center portion 79 and that is calculated from the discharge amount (suction amount) required for the electromagnetic pump 20, the flow rate of working oil that passes through the center portion 79, the resistance against flow of the working oil, and so forth. In addition, the plug 78 is formed with a tapered portion 79*a* that communicates with the center portion 79 and that becomes gradually larger in inside diameter from the left toward the right in FIG. 5. The ball 74 abuts against the tapered portion 79*a* to be positioned. Further, the plug 78 is formed with a straight portion 79*b* provided on an end surface 78*b*1 side of the flange portion 78*b* and extending over a predetermined length such that the straight portion 79*b* has an inside diameter D2 that is equivalent to the diameter of the pore forming region 92*a* of the strainer 90. The size and the number of the pores of the strainer 90 are determined as follows. For example, the size of the pores is calculated in consideration of the size of foreign matter desired to be trapped, the flow rate of working oil that passes through the pores, the resistance against flow of the working oil, and so forth. The number of the pores is calculated on the basis of the calculated size of the pores and the flow amount at the center portion 79 discussed above so that a necessary flow amount of working oil can be sucked. The diameter of the pore forming region 92*a*, that is, the inside diameter D2, is determined from the thus calculated size and number of the pores. In the embodiment, the inside diameter D2 is determined to be larger than the outside diameter of the cylindrical portion 78*a*. In addition, the plug 78 is formed with a diameter reducing portion 79*c*, the inside diameter of which becomes gradually smaller from the flange portion 78*b* side toward the cylindrical portion 78*a* side (from the left toward the right in FIG. 5). The diameter reducing portion 79*c* includes two stages of tapered surfaces 79*c*1 and 79*c*2 with different inclination angles of the surface with respect to the axial center of the center portion 79. The diameter reducing portion 79*c* is formed such that the inclination angle (angle β in FIG. 5) of the tapered surface 79*c*2 is smaller than the inclination angle (angle α in FIG. 5) of the tapered surface 79*c*1. Therefore, the tapered surfaces 79*c*1 and 79*c*2 are different from each other in degree of diameter reduction. The degree of diameter reduction in the tapered surface 79*c*2 is smaller than the degree of diameter reduction in the tapered surface 79*c*1. That is, the diameter reducing portion 79*c* is formed such that the inside diameter of the through hole 78*c* is reduced from the inside diameter D2 to the inside diameter D1 with the degree of diameter reduction varied from a large value to a small value. The reason that the diameter reducing portion 79*c* is thus formed will be described below. FIGS. 6A to 6C show comparative examples for cases where the diameter reducing portion is formed differently from that in the embodiment.

First, FIG. 6A shows Comparative Example 1 in which a tapered surface at an inclination angle α (inclination angle of the tapered surface 79*c*1) is formed from the center portion 79 with the inside diameter D1 to the straight portion 79*b* with the inside diameter D2. As shown in the drawing, the thickness T at the boundary portion between the cylindrical portion 78*a* and the flange portion 78*b* is significantly small compared to the embodiment, and therefore the rigidity of the plug 78 may be insufficient. In the embodiment, in particular, the inside diameter D2 is larger than the outside diameter of the cylindrical portion 78*a*, and thus the thickness T tends to be small. Next, FIG. 6B shows Comparative Example 2 in which a tapered surface at an inclination angle α is formed from the straight portion 79*b* with the inside diameter D2 to the center portion 79 with the inside diameter D1 such that the thickness T is maintained at the same value as in the embodiment. As shown in the drawing, the length L of the center portion 79 is larger than that in the embodiment, which may hinder working oil from flowing smoothly. Subsequently, FIG. 6C shows Comparative Example 3 in which a tapered surface at an inclination angle β (inclination angle of the tapered surface 79*c*2) is formed from the center portion 79 with the inside diameter D1 to the straight portion 79*b* with the inside diameter D2. As shown in the drawing, the thickness of the flange portion 78*b* is increased compared to that in the embodiment, which makes the plug 78 larger. This also makes the suction check valve 70 larger, leading to an increase in size of the electromagnetic pump 20. If the inside diameter D1 and the inside diameter D2 are thus connected by one stage of tapered surface with a constant inclination angle, the thickness T of the plug 78 may be insufficient to result in insufficient rigidity, the length L of the center portion 79 may be longer to hinder working oil from flowing smoothly, or the thickness of the flange portion 78*b* may be increased to lead to an increase in size of the suction check valve 70 (electromagnetic pump 20). In the embodiment, in contrast, the inside diameter of the through hole 78*c* is increased to the inside diameter D2 while the thickness T at a sufficient value is ensured with the tapered surface 79*c*2 with a small degree of diameter reduction and an increase in thickness of the flange portion 78*b* is suppressed with the tapered surface 79*c*1 with a large degree of diameter reduction. In addition, the diameter reducing portion 79*c* is gradually reduced in diameter from the flange portion 78*b* side toward the cylindrical portion 78*a* side, which allows working oil to be smoothly sucked. This allows working oil to be smoothly sucked while securing the rigidity of the plug 78 and preventing an increase in size of the plug 78. For this reason, the diameter reducing portion 79*c* is formed such that the inside diameter of the through hole 78*c* of the plug 78 is reduced from the inside diameter D2 to the inside diameter D1 with the degree of diameter reduction varied from a large value to a small value.

In the embodiment, in addition, the thus configured diameter reducing portion 79*c* is implemented by providing the two stages of tapered surfaces 79*c*1 and 79*c*2. Thus, the diameter reducing portion 79*c* can be formed relatively easily without requiring complicated processing. In the embodiment, further, an inflection point P (see FIG. 5) at which the inclination angle of the two stages of tapered surfaces 79*c*1 and 79*c*2 is varied is determined in such a range that the thickness T at the boundary portion between the cylindrical portion 78*a* and the flange portion 78*b* is equal to or more than a predetermined thickness and at such a position that the thickness of the flange portion 78*b* can be made as small as possible. Therefore, the thickness of the flange portion 78*b* can be suppressed while the thickness T of the plug 78 is more reliably secured. The predetermined thickness may be determined as a thickness that can secure the rigidity, durability, etc. required for the plug 78 in consideration of the pressure, flow amount, etc. of working oil sucked via the strainer 90, for example. In addition, the straight portion 79*b* is formed between the end surface 78*b*1 of the flange portion 78*b* and the diameter reducing portion 79*c*. Thus, working oil can be caused to smoothly flow in, and the annular area of the end surface 78*b*1 can be increased to more appropriately receive the pressure of working oil applied to the cylinder cover 48 and the strainer 90, compared to a configuration in which the tapered surface is extended to the end surface 78*b*1. That is, the end surface 78*b*1 covered by the strainer 90 functions as a pressure receiving surface that receives the pressure of working oil applied to the cylinder cover 48 and the strainer 90. Thus, an increase in area of the end surface 78*b*1 can prevent an excessive stress from acting on the strainer 90 and the flange portion 78*b* (plug 78).

The suction check valve 70 opens with the spring 76 compressed and the ball 74 moved away from the plug 78 when the pressure difference (P1−P2) between the input-side pressure P1 and the output-side pressure P2 is equal to or more than a predetermined pressure to overcome the urging force of the spring 76. The suction check valve 70 closes with the spring 76 expanded and the ball 74 pressed against the tapered portion 79*a* of the plug 78 to block the through hole 78*c* when the pressure difference (P1−P2) discussed above is less than the predetermined pressure.

Figure 7:
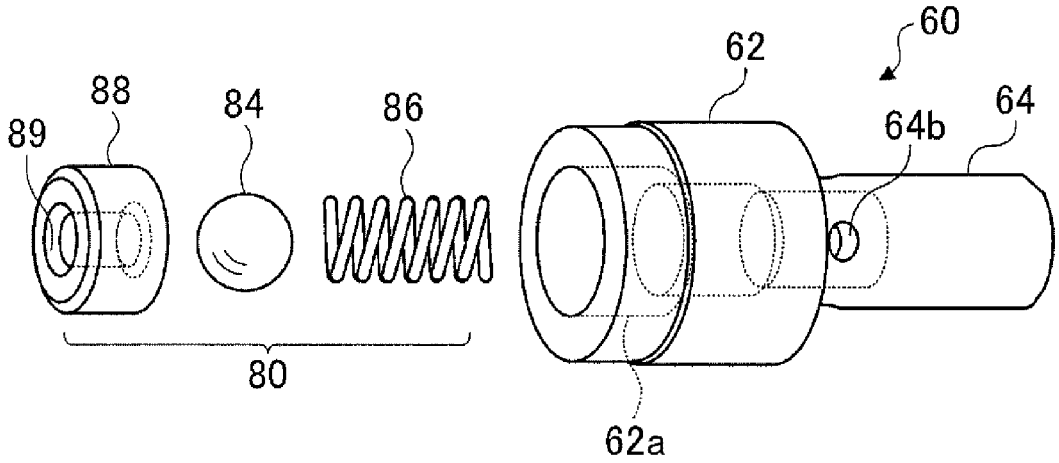
FIG. 7 illustrates how a discharge check valve 80 is assembled to a piston 60.
Figure 8:
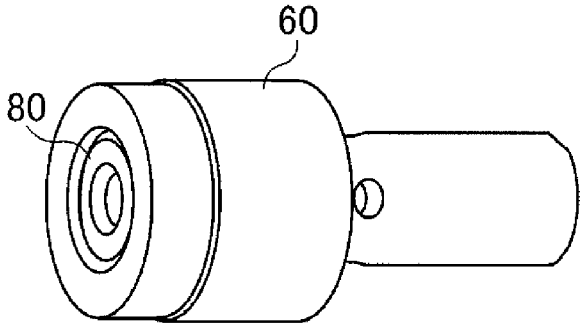
FIG. 8 shows the appearance of the discharge check valve 80 and the piston 60 after being assembled.

The discharge check valve 80 includes a ball 84, a spring 86 that provides an urging force to the ball 84, and a plug 88 formed as an, annular member with a center hole 89 having an inside diameter that is smaller than the outside diameter of the ball 84. FIG. 7 illustrates how the discharge check valve 80 is assembled. FIG. 8 shows the appearance of the discharge check valve 80 and the piston 60 after being assembled. As shown in the drawing, the discharge check valve 80 is assembled by sequentially inserting the spring 86 and the ball 84 into the hollow portion 62*a* of the piston 60, and press-fitting the plug 88 into the hollow portion 62*a*. The plug 88 may be fixed to the piston 60 by a fixing member such as a snap ring. In the embodiment, the discharge check valve 80 is assembled to the piston 60 in this way to form a sub-assembly (see FIG. 8).

The discharge check valve 80 opens with the spring 86 compressed and the ball 84 moved away from the center hole 89 of the plug 88 when the pressure difference (P2−P3) between the input-side pressure (pressure on the output side of the suction check valve 70) P2 and the output-side pressure P3 is equal to or more than a predetermined pressure to overcome the urging force of the spring 86. The discharge check valve 80 closes with the spring 86 expanded and the ball 84 pressed against the center hole 89 of the plug 88 to block the center hole 89 when the pressure difference (P2−P3) discussed above is less than the predetermined pressure.

In the cylinder 50, the pump chamber 56 is formed as a space surrounded by an inner wall 51, the distal-end surface of the piston 60, and a surface of the suction check valve 70 on the spring 46 side. When the piston 60 is moved by the urging force of the spring 46, the volume inside the pump chamber 56 is expanded to open the suction check valve 70 and close the discharge check valve 80 to suck working oil via the suction port 42. When the piston 60 is moved by the electromagnetic force of the solenoid portion 30, the volume inside the pump chamber 56 is reduced to close the suction check valve 70 and to open the discharge check valve 80 to discharge the sucked working oil via the discharge port 44.

The cylinder 50 is formed with a step between an inner wall 52, over which the piston main body 62 slides, and an inner wall 54, over which the shaft portion 64 slides. The discharge port 44 is formed at the stepped portion. The stepped portion forms a space surrounded by an annular surface of the stepped portion between the piston main body 62 and the shaft portion 64, and the outer peripheral surface of the shaft portion 64. The space is formed on the opposite side of the piston main body 62 from the pump chamber 56. Thus, the volume of the space is reduced when the volume of the pump chamber 56 is expanded, and expanded when the volume of the pump chamber 56 is reduced. In this event, variations in volume of the space are smaller than variations in volume of the pump chamber 56 because the area (pressure receiving area) over which the piston 60 receives a pressure from the pump chamber 56 side is larger than the area (pressure receiving area) over which the piston 60 receives a pressure from the discharge port 44 side. Therefore, the space serves as a second pump chamber 58. That is, when the piston 60 is moved by the urging force of the spring 46, an amount of working oil corresponding to the amount of expansion in volume of the pump chamber 56 is sucked from the suction port 42 into the pump chamber 56 via the suction check valve 70, and an amount of working oil corresponding to the amount of reduction in volume of the second pump chamber 58 is discharged from the second pump chamber 58 via the discharge port 44. When the piston 60 is moved by the electromagnetic force of the solenoid portion 30, an amount of working oil corresponding to the amount of reduction in volume of the pump chamber 56 is fed from the pump chamber 56 into the second pump chamber 58 via the discharge check valve 80, and an amount of working oil corresponding to the difference between the amount of reduction in volume of the pump chamber 56 and the amount of expansion in volume of the second pump chamber 58 is discharged via the discharge port 44. Thus, working oil is discharged from the discharge port 44 twice while the piston 60 moves back and forth once, which makes it possible to reduce discharge non-uniformities and improve the discharge performance.

Figure 9:
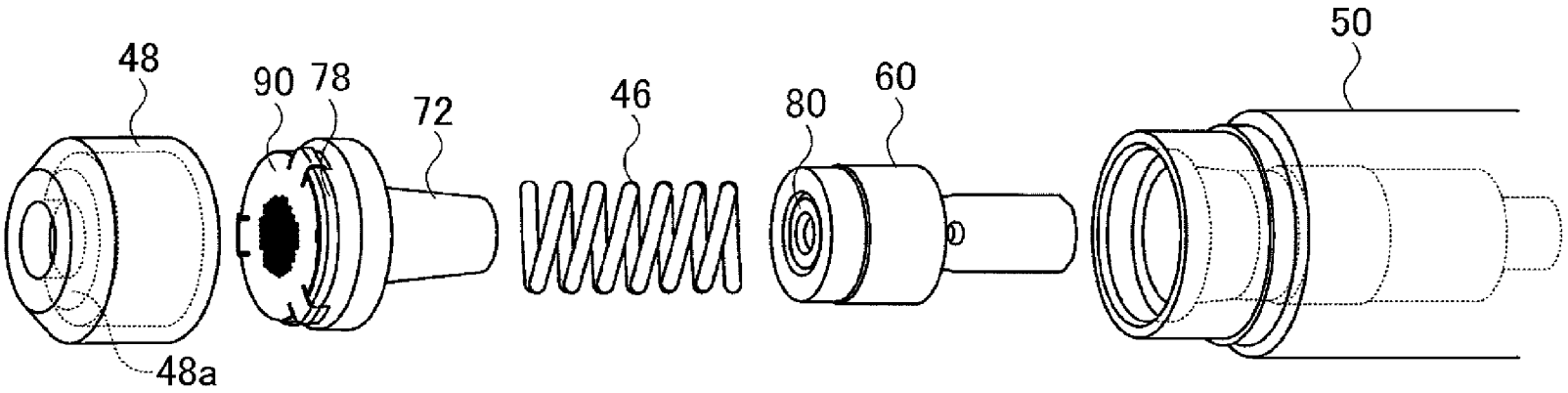
FIG. 9 illustrates how the piston 60, the discharge check valve 80, a spring 46, the suction check valve 70, and a strainer 90 are assembled to a cylinder 50.

FIG. 9 illustrates how the electromagnetic pump 20 according to the embodiment is assembled. The electromagnetic pump 20 according to the embodiment is assembled by sequentially inserting the sub-assembly of the piston 60 and the discharge check valve 80, the spring 46, and the sub-assembly of the suction check valve 70 and the strainer 90 into the cylinder 50, and thereafter attaching the cylinder cover 48. The outer peripheral surface of the cylinder 50 and the inner peripheral surface of the cylinder cover 48 are engraved with spiral threads (not shown), and the cylinder cover 48 is attached by placing the cylinder cover 48 over the cylinder 50 and screwing the cylinder cover 48. When the cylinder cover 48 is attached, the outer peripheral edge of the strainer 90 is pressed by an annular pressing surface 48*a* of the cylinder cover 48 to fix the strainer 90.

In the electromagnetic pump 20 according to the embodiment described above, the suction check valve 70 is formed with the diameter reducing portion 79*c* formed such that the inside diameter of the through hole 78*c* is reduced from the flange portion 78*b* of the plug 78 toward the cylindrical portion 78*a* with the degree of diameter reduction varied from a large value to a small value. Thus, the thickness T at the boundary portion between the flange portion 78*b* and the cylindrical portion 78*a* can be secured while an increase in thickness of the flange portion 78*b* is suppressed compared to a configuration in which the degree of diameter reduction is constant. In addition, working oil can be smoothly sucked due to diameter reduction at the diameter reducing portion 79*c*. As a result, working oil can be smoothly sucked and an increase in size of the suction check valve 70 can be prevented, providing the electromagnetic pump 20 with a compact configuration.

In addition, the diameter reducing portion 79*c* is formed from the two stages of tapered surfaces 79*c*1 and 79*c*2, and therefore can be formed through relatively easy processing. Further, the inflection point P that serves as the boundary between the respective inclination angles of the two stages of tapered surfaces 79*c*1 and 79*c*2 is determined in such a range that the thickness T at the boundary portion between the cylindrical portion 78*a* and the flange portion 78*b* is equal to or more than a predetermined thickness. Thus, the thickness T can be more reliably secured. The straight portion 79*b* is formed between the end surface 78*b*1 of the flange portion 78*b* and the diameter reducing portion 79*c*. Thus, working oil can be more smoothly sucked, and the pressure of working oil applied to the strainer 90 can be received by the end surface 78*b*1 more appropriately. In addition, the suction check valve 70 is built in the cylinder 50, providing the electromagnetic pump 20 with a compact configuration.

In the electromagnetic pump 20 according to the embodiment, the diameter reducing portion 79*c* of the plug 78 of the suction check valve 70 is formed from the two stages of tapered surfaces 79*c*1 and 79*c*2. However, the diameter reducing portion 79*c* may be formed from a plurality of stages, namely three or more stages, of tapered surfaces, or may be formed from a plurality of staircase-like stepped surfaces or rounded curved surfaces in section, rather than tapered surfaces.

In the electromagnetic pump 20 according to the embodiment, the inside diameter D2 is equivalent to the diameter of the pore forming region 92*a* and larger than the outside diameter of the cylindrical portion 78*a*. However, the inside diameter D2 may be equivalent to or smaller than the outside diameter of the cylindrical portion 78*a*.

In the electromagnetic pump 20 according to the embodiment, the straight portion 79*b* is formed on the plug 78 of the suction check valve 70. However, the straight portion 79*b* may not be formed.

In the electromagnetic pump 20 according to the embodiment, the suction check valve 70 is built in the cylinder 50. However, a suction check valve may be incorporated in a valve body outside the cylinder 50, rather than being built in the cylinder 50. In this case, the suction check valve may be formed by closing the opening of the cylinder 50 in which the suction check valve 70 is disposed and forming a suction port that leads to the pump chamber, attaching the strainer 90 to the flange portion 78*b* such that the strainer 90 covers the end surface 78*b*1 of the plug 78 of the suction check valve 70, and connecting between the suction port of the pump chamber of the cylinder 50 and the output port (corresponding to the center hole 72*b* in the embodiment) of the suction check valve 70 through an oil passage.

The electromagnetic pump 20 according to the embodiment is configured such that working oil is discharged from the discharge port 44 twice while the piston 60 moves back and forth once. However, the present invention is not limited thereto, and the electromagnetic pump 20 according to the embodiment may be any type of electromagnetic pump, such as a type in which working oil is sucked from the suction port into the pump chamber when the piston is moved forward by the electromagnetic force from the solenoid portion and the working oil in the pump chamber is discharged from the discharge port when the piston is moved backward by the urging force of the spring, and a type in which working oil is sucked from the suction port into the pump chamber when the piston is moved backward by the urging force of the spring and the working oil in the pump chamber is discharged from the discharge port when the piston is moved forward by the electromagnetic force from the solenoid portion.

The electromagnetic pump 20 according to the embodiment is used for a hydraulic control device that hydraulically drives clutches and brakes of an automatic transmission mounted on an automobile. However, the present invention is not limited thereto, and the electromagnetic pump 20 according to the embodiment may be applied to any system that transports fuel, transports a liquid for lubrication, or the like.

Here, the correspondence between the main elements of the embodiment and the main elements of the invention described in the "SUMMARY OF THE INVENTION" section will be described. In the embodiment, the strainer 90 corresponds to the "strainer". The cylindrical portion 78*a* of the plug 78 corresponds to the "tubular portion". The flange portion 78*b* corresponds to the "flange portion". The through hole 78*c* corresponds to the "through hole". The suction check valve 70 corresponds to the "suction check valve". The diameter reducing portion 79*c* corresponds to the "diameter reducing portion". The correspondence between the main elements of the embodiment and the main elements of the invention described in the "SUMMARY OF THE INVENTION" section does not limit the elements of the invention described in the "SUMMARY OF THE INVENTION" section, because the embodiment is an example given for the purpose of specifically describing the best mode for carrying out the invention described in the "SUMMARY OF THE INVENTION" section. That is, the invention described in the "SUMMARY OF THE INVENTION" section should be construed on the basis of the description in that section, and the embodiment is merely a specific example of the invention described in the "SUMMARY OF THE INVENTION" section.

While a mode for carrying out the present invention has been described above by way of an embodiment, it is a matter of course that the present invention is not limited to the embodiment in any way, and that the present invention may be implemented in various forms without departing from the scope and sprit of the present invention.

The present invention is applicable to the electromagnetic pump device manufacturing industry and so forth.

The invention claimed is:

1. An electromagnetic pump device comprising:

a suction check valve including a tubular portion and a flange portion that extends in a radial direction from an end edge of the tubular portion, the suction check valve being formed with a through hole that penetrates the tubular portion and the flange portion to form a suction port in an end surface of the flange portion; and a strainer attached so as to cover the end surface of the flange portion to form the suction port and having a pore forming region which is larger than an inside diameter of the through hole at the tubular portion and in which a large number of pores are formed, wherein the suction check valve is formed with a diameter reducing portion formed such that the inside diameter of the through hole is reduced from the flange portion toward the tubular portion with a degree of diameter reduction varied from a large value to a small value, and the diameter reducing portion is formed from at least two stages of adjacent tapered surfaces of which inclination angles with respect to an axial center of the through hole are larger than 0 degrees and smaller than 90 degrees, and which become smaller from the end surface of the flange portion toward the tubular portion.

2. The electromagnetic pump device according to claim 1, wherein in the diameter reducing portion, an inflection point at which the inclination angle of the two stages of tapered surfaces is varied is determined at a position at which a thickness at a boundary portion between the tubular portion and the flange portion is equal to or more than a predetermined thickness.

3. The electromagnetic pump device according to claim 1, wherein the suction check valve includes a straight portion provided between the end surface of the flange portion and the diameter reducing portion, the straight portion having a uniform diameter corresponding to an inside diameter of the suction port.

4. The electromagnetic pump device according to claim 1, wherein the suction check valve is formed such that the inside diameter of the suction port is larger than an outside diameter of the tubular portion.

5. The electromagnetic pump device according to claim 1 in which a piston moves back and forth within a cylinder to pump a working fluid, wherein the suction check valve is built in the cylinder.

6. The electromagnetic pump device according to claim 1, wherein the diameter reducing portion is formed from two stages of tapered surfaces.

7. The electromagnetic pump device according to claim 1, wherein the at least two stages of tapered surfaces include a first and second tapered surfaces, the first tapered surface being closer to the end surface of the flange portion, and the end edge and the first tapered surface overlap each other as seen in an axial direction of the electromagnetic pump device, and the end edge and the second tapered surface overlap each other as seen in a radial direction of the electromagnetic pump device.

* * * * *